US010364485B2

(12) United States Patent
Asano et al.

(10) Patent No.: US 10,364,485 B2
(45) Date of Patent: Jul. 30, 2019

(54) ALUMINUM ALLOY SHEET THAT EXHIBITS EXCELLENT SURFACE QUALITY AFTER ANODIZING AND METHOD FOR PRODUCING THE SAME

(71) Applicant: UACJ Corporation, Chiyoda-ku, Tokyo OT (JP)

(72) Inventors: Mineo Asano, Tokyo (JP); Yusuke Yamamoto, Tokyo (JP)

(73) Assignee: UACJ CORPORATION, Chiyoda-Ku, Tokyo (JP)

( * ) Notice: Subject to any disclaimer, the term of this patent is extended or adjusted under 35 U.S.C. 154(b) by 822 days.

(21) Appl. No.: 13/930,685

(22) Filed: Jun. 28, 2013

(65) Prior Publication Data

US 2014/0044588 A1 Feb. 13, 2014

(30) Foreign Application Priority Data

Aug. 8, 2012 (JP) ..... 2012-175697

(51) Int. Cl.

| | |
|---|---|
| ***C22C 21/08*** | (2006.01) |
| ***C22C 21/06*** | (2006.01) |
| ***C22C 21/00*** | (2006.01) |
| ***B21B 1/26*** | (2006.01) |
| ***C22F 1/047*** | (2006.01) |

(52) U.S. Cl.

CPC ..... *C22C 21/08* (2013.01); *B21B 1/26* (2013.01); *C22C 21/00* (2013.01); *C22C 21/06* (2013.01); *C22F 1/047* (2013.01)

(58) Field of Classification Search

CPC ..... C22C 21/00; C22C 21/06; C22C 21/08
USPC ..... 148/437–440; 420/532
See application file for complete search history.

(56) References Cited

U.S. PATENT DOCUMENTS

2008/0289731 A1* 11/2008 Uesugi et al. ..... 148/692

FOREIGN PATENT DOCUMENTS

| | | | | |
|---|---|---|---|---|
| CN | 101311282 A | | 11/2008 | |
| CN | 104364402 A | | 2/2015 | |
| EP | 2263811 A1 | * | 12/2010 | ..... C22B 21/06 |
| JP | 09-143602 A | | 6/1997 | |

OTHER PUBLICATIONS

China Patent Office Action with Partial English Translation, dated Jun. 23, 2016 (18 pgs).

* cited by examiner

*Primary Examiner* — Brian D Walck
(74) *Attorney, Agent, or Firm* — Flynn Thiel, P.C.

(57) ABSTRACT

An anodized aluminum alloy sheet exhibits excellent surface quality without showing a band-like streak pattern and is formed from a 5000 series aluminum alloy sheet that includes 1.0 to 6.0 mass % of Mg, wherein the concentration of Mg in a solid-solution state that is present in an outermost surface area of the aluminum alloy sheet varies in the widthwise direction of the aluminum alloy sheet in the form of a band having a width of 0.05 mm or more, and the difference in the concentration of Mg between adjacent bands is 0.20 mass % or less.

3 Claims, No Drawings

ALUMINUM ALLOY SHEET THAT EXHIBITS EXCELLENT SURFACE QUALITY AFTER ANODIZING AND METHOD FOR PRODUCING THE SAME

BACKGROUND

The invention relates to an aluminum alloy sheet that exhibits an excellent surface quality after anodizing without showing a band-like streak pattern, and a method for producing the same.

In recent years, an aluminum alloy sheet has been increasingly applied to automotive interior parts and outer panels for consumer electronics. These products are required to exhibit an excellent surface quality, and are often used in an anodized state. However, an outer panel for consumer electronics may show a streak pattern after anodizing, for example. Therefore, an aluminum alloy sheet that does not show a streak pattern after anodizing has been desired.

Various attempts have been made to prevent such a streak pattern, and methods that control the chemical components, the crystal grain size of the final sheet, the dimensions and the distribution density of precipitates, or the like have been proposed. However, a streak pattern may not be sufficiently prevented by these methods.

JP-A-2000-273563 and JP-A-2006-52436 disclose related-art technology.

SUMMARY OF THE INVENTION

The inventors of the invention found that the occurrence of a band-like streak pattern after anodizing is affected by an element (peritectic element) that undergoes a peritectic reaction with aluminum and is present in a solid-solution state, and proposed a method that controls the state of the peritectic element. However, it was found that a streak pattern may occur even when the above method is employed.

The inventors conducted further tests and studies, and found that the state of Mg that is present in a solid-solution state in an aluminum alloy that includes Mg that undergoes a eutectic reaction with aluminum affects the occurrence of a band-like streak pattern after anodizing. The invention was conceived based on the above finding. An object of the invention is to provide an aluminum alloy sheet that exhibits an excellent surface quality after anodizing without showing a band-like streak pattern, and a method for producing the same.

According to a first aspect of the invention, an aluminum alloy sheet that exhibits an excellent surface quality after anodizing is a 5000 series aluminum alloy sheet that includes 1.0 to 6.0 mass % of Mg, and requires an anodic oxide coating, a concentration of Mg in a solid-solution state that is present in an outermost surface area of the aluminum alloy sheet varying in a widthwise direction of the aluminum alloy sheet in a form of a band having a width of 0.05 mm or more, and a difference in the concentration of Mg between adjacent bands being 0.20 mass % or less. Note that the unit "mass %" may be hereinafter referred to as "%".

The aluminum alloy sheet may include 1.0 to 6.0 mass % of Mg, and one or two or more elements among 0.001 to 0.1 mass % of Ti, 0.4 mass % or less of Cr, 0.5 mass % or less of Cu, 0.5 mass % or less of Mn, 0.4 mass % or less of Fe, and 0.3 mass % or less of Si, with the balance being Al and unavoidable impurities.

According to a second aspect of the invention, a method for producing the aluminum alloy sheet according to the first aspect of the invention includes subjecting an ingot to hot rolling and cold rolling to produce an aluminum alloy sheet, a rolling target side of the ingot having a structure in which a difference in the concentration of Mg between an area having a diameter of 5 μm and positioned in a center area of a crystal grain and an area having a diameter of 5 μm and positioned away from a grain boundary of the crystal grain by 2.5 μm is 0.80 mass % or less.

The aspects of the invention may thus provide an aluminum alloy sheet that exhibits an excellent surface quality after anodizing without showing a band-like streak pattern, and a method for producing the same.

DESCRIPTION OF EXEMPLARY EMBODIMENTS

An aluminum alloy sheet according to one embodiment of the invention is a 5000 series aluminum alloy sheet that includes Mg and is characterized in that the concentration of Mg in a solid-solution state that is present in the outermost surface area of the aluminum alloy sheet varies in the widthwise direction of the aluminum alloy sheet in the form of a band having a width of 0.05 mm or more, and the difference in the concentration of Mg between adjacent bands is 0.20% or less. It is possible to obtain an anodized aluminum alloy sheet that exhibits an excellent surface quality without showing a band-like streak pattern by anodizing an aluminum alloy sheet having the above features. If the difference in the concentration of Mg between adjacent bands exceeds 0.20%, a streak pattern may be observed with the naked eye after anodizing (i.e., an excellent surface quality may not be obtained).

Mg is incorporated in an anodic oxide coating in a solid-solution state due to anodizing. When anodizing an aluminum alloy sheet having the above features, the resulting anodized aluminum alloy sheet also has a structure in which the concentration of Mg in a solid-solution state that has been incorporated in the anodic oxide coating varies in the widthwise direction of the aluminum alloy sheet in the form of a band having a width of 0.05 mm or more, and the difference in the concentration of Mg between adjacent bands is 0.05% or less.

The concentration of Mg in a solid-solution state is determined by a linear analysis that measures the concentration of the peritectic element from fluorescent X-rays that are generated by applying electron beams at a pitch of 10 μm using an electron probe microanalyser (EPMA), and the difference in the concentration of Mg between adjacent bands is calculated.

Mg improves the strength of the 5000 series aluminum alloy sheet according to one embodiment of the invention. The Mg content is preferably 1.0 to 6.0%. If the Mg content is less than 1.0%, Mg may not exhibit a sufficient strength-improving effect. If the Mg content exceeds 6.0%, cracks may easily occur during hot rolling.

The aluminum alloy sheet according to one embodiment of the invention may include one or more elements among the following alloy elements in addition to Mg.

Ti

Ti is used as an element that suppresses the coarsening of the cast structure. The Ti content is preferably 0.001 to 0.1%. If the Ti content is less than 0.001%, the coarsening of the cast structure may not be suppressed. If the Ti content exceeds 0.1%, coarse intermetallic compounds may be produced, and a streak pattern due to the intermetallic compounds may be observed after anodizing.

Cr

Cr is used as an element that improves the strength of the aluminum alloy sheet, and refines the crystal grains. The Cr content is preferably 0.4% or less. If the Cr content exceeds 0.4%, coarse intermetallic compounds may be produced, and a streak pattern due to the intermetallic compounds may be observed after anodizing.

Cu

Cu improves the strength of the aluminum alloy sheet, and ensures that the entire anodic oxide coating has a uniform color tone. The Cu content is preferably 0.5% or less. If the Cu content exceeds 0.5%, Al—Cu precipitates (intermetallic compounds) may be formed, and a streak pattern may occur, or the anodic oxide coating may become turbid due to the intermetallic compounds.

Mn

Mn improves the strength of the aluminum alloy sheet, and refines the crystal grains. The Mn content is preferably 0.5% or less. If the Mn content exceeds 0.5%, Al—Mn—Si or Al—Mn crystallized products or precipitates (intermetallic compounds) may be formed, and a streak pattern may occur, or the anodic oxide coating may become turbid due to the intermetallic compounds.

Fe

Fe improves the strength of the aluminum alloy sheet, and refines the crystal grains. The Fe content is preferably 0.4% or less. If the Fe content exceeds 0.4%, Al—Fe—Si or Al—Fe crystallized products or precipitates (intermetallic compounds) may be formed, and a streak pattern may occur, or the anodic oxide coating may become turbid due to the intermetallic compounds.

Si

Si improves the strength of the aluminum alloy sheet, and refines the crystal grains. The Si content is preferably 0.3% or less. If the Si content exceeds 0.3%, Al—Fe—Si crystallized products or Si precipitates (intermetallic compounds) may be formed, and a streak pattern may occur, or the anodic oxide coating may become turbid due to the intermetallic compounds. Note that the Fe content and the Si content are preferably 0.01% or more since the production cost increases when using a high purity ground metal.

The aluminum alloy sheet according to one embodiment of the invention necessarily includes Zn and the like as unavoidable impurities. The advantageous effects of the invention are not affected when the content of each unavoidable impurity element is 0.25% or less.

A method for producing an aluminum alloy sheet according to one embodiment of the invention is described below. The method for producing an aluminum alloy sheet according to one embodiment of the invention includes subjecting an ingot to hot rolling and cold rolling to produce an aluminum alloy sheet, the rolling target side of the ingot having a structure in which the difference in concentration of Mg between an area having a diameter of 5 μm and positioned in a center area of a crystal grain and an area having a diameter of 5 μm and positioned away from the grain boundary of the crystal grain by 2.5 μm is 0.80 mass % or less. An aluminum alloy sheet produced using such an ingot exhibits an excellent surface quality after anodizing without showing a band-like streak pattern.

The rolling target side of an ingot that has been cast using a normal semicontinuous casting method, and then homogenized has a cast structure in which crystal grains formed during casting have an average grain size of 50 to 500 μm. For example, crystal grains at several points of each (upper and lower) rolling target side of the ingot are subjected to point analysis that measures the concentration of Mg from fluorescent X-rays that are generated by applying electron beams using an EPMA in an area having a diameter of 5 μm and positioned in the center area of a crystal grain and an area having a diameter of 5 μm and positioned away from the grain boundary of the crystal grain by 2.5 μm to determine the difference in the concentration of Mg. When the difference in the concentration of Mg is 0.80% or less, an aluminum alloy sheet that is to be anodized is produced using the ingot.

In order to obtain an ingot which is obtained by casting and homogenizing an aluminum alloy molten metal that includes Mg, and of which the rolling target side has a structure in which the difference in the concentration of Mg between an area having a diameter of 5 μm and positioned in the center area of a crystal grain and an area having a diameter of 5 μm and positioned away from the grain boundary of the crystal grain by 2.5 μm is 0.80% or less, it is preferable to homogenize the cast ingot at a temperature equal to or higher than a temperature less than the solidus temperature of the aluminum alloy (more preferably at a temperature equal to or higher than "solidus temperature−50° C.") for more than 3 hours.

EXAMPLES

The invention is further described below by way of examples and comparative examples to demonstrate the advantageous effects of the invention. Note that the following examples merely illustrate several embodiments of the invention, and the invention is not limited to the following examples.

Example 1 and Comparative Example 1

An ingot of an aluminum alloy (A to D) having the composition shown in Table 1 was cast using a DC casting method. The resulting ingot (thickness: 500 mm, width: 1200 mm (transverse cross-sectional dimensions)) was homogenized under the conditions shown in Table 2, and cooled to room temperature. The upper side (rolling target side), the lower side (rolling target side), the right side, and the left side of the ingot were respectively faced by 25 mm. The crystal grains of the rolling target side of the ingot were subjected to point analysis (five points) using an EPMA to determine the distribution state of Mg in a solid-solution state. The difference in the concentration of Mg between an area having a diameter of 5 μm and positioned in the center area of the crystal grain and an area having a diameter of 5 μm and positioned away from the grain boundary of the crystal grain by 2.5 μm was calculated.

Note that the solidus temperature of the alloy A is 620° C., the solidus temperature of the alloy B is 585° C., the solidus temperature of the alloy C is 560° C., and the solidus temperature of the alloy D is 620° C. The homogenization temperature range for the alloy A is preferably 570° C. or more and less than 620° C., the homogenization temperature range for the alloy B is preferably 535° C. or more and less than 585° C., the homogenization temperature range for the alloy C is preferably 510° C. or more and less than 560° C., and the homogenization temperature range for the alloy D is preferably 570° C. or more and less than 620° C. The homogenization temperature was selected as shown in Table 2. The homogenization treatment time for the alloy A was set to 5 h, the homogenization treatment time for the alloy B was set to 12 h, the homogenization treatment time for the alloy C was set to 24 h, and the homogenization treatment time for the alloy D was set to 5 h (>3 h).

The homogenized ingot was heated to 470° C., and hot-rolled to a thickness of 6.0 mm. The hot rolling finish temperature was set to 250° C. The ingot was then cold-rolled to a thickness of 1.0 mm, and softened at 420° C. for 1 hour.

The resulting sheet material (samples 1 to 8) was subjected to linear analysis (in an arbitrary five areas having a length of 10 mm in the widthwise direction) using an EPMA to determine the distribution state of Mg in a solid-solution state to calculate the difference in the concentration of Mg between adjacent bands. A plurality of bands were measured by the linear analysis (length: 10 mm), and a plurality of concentration differential values were obtained. The maximum difference in concentration between adjacent bands was taken as a representative value. The average value of the five representative values was calculated.

The sheet material was surface-roughened by shot blasting, chemically polished using phosphoric acid and sulfuric acid, and anodized using sulfuric acid to form an anodic oxide coating having a thickness of 10 μm. The presence or absence of a band-like streak pattern on the anodized sheet was determined with the naked eye. The anodized sheet was subjected to linear analysis (in five areas (streak pattern areas when a streak pattern was observed) having a length of 10 mm in the widthwise direction) using an EPMA to determine the distribution state of Mg in a solid-solution state, and the difference in the concentration of Mg between adjacent bands was calculated. A plurality of bands were measured by the linear analysis (length: 10 mm), and a plurality of concentration differential values were obtained. The maximum difference in concentration between adjacent bands was taken as a representative value. The average value of the five representative values was calculated.

The results are shown in Tables 2 and 3. In Table 2, a value that does not fall under the requirement of the invention is underlined. As shown in Table 2, when using the inventive samples 1 to 4, the homogenized ingot had a structure in which the difference in the concentration of Mg between the area having a diameter of 5 μm and positioned in the center area of the crystal grain and the area having a diameter of 5 μm and positioned away from the grain boundary of the crystal grain by 2.5 μm was 0.80% or less, and the unanodized sheet material had a structure in which the difference in the concentration of Mg between adjacent bands was 0.20% or less.

As shown in Table 3, the samples 1 to 4 exhibited an excellent surface quality after anodizing without showing a band-like streak pattern. The anodized sheet material had a structure in which the difference in the concentration of Mg between adjacent bands was 0.05% or less.

In contrast, when using the samples 5 to 8 that were homogenized at a low temperature, the homogenized ingot had a structure in which the difference in the concentration of Mg between the area having a diameter of 5 μm and positioned in the center area of the crystal grain and the area having a diameter of 5 μm and positioned away from the grain boundary of the crystal grain by 2.5 μm exceeded 0.80%, and the unanodized sheet material had a structure in which the difference in the concentration of Mg between adjacent bands exceeded 0.20%. As shown in Table 3, the anodized sheet material showed a band-like streak pattern after anodizing, and had a structure in which the difference in the concentration of Mg between adjacent bands exceeded 0.05%.

TABLE 1

| | Chemical component (mass %) | | | | | | | | |
|---|---|---|---|---|---|---|---|---|---|
| Alloy | Si | Fe | Cu | Mn | Mg | Cr | Zn | Ti | Al |
| A | 0.03 | 0.07 | 0.41 | <0.01 | 1.08 | <0.01 | <0.01 | <0.01 | Bal. |
| B | 0.15 | 0.28 | 0.05 | 0.48 | 3.52 | 0.35 | 0.08 | 0.09 | Bal. |
| C | 0.29 | 0.38 | 0.09 | 0.11 | 5.58 | 0.04 | 0.01 | 0.02 | Bal. |
| D | 0.04 | 0.08 | 0.43 | 0.01 | 1.06 | 0.01 | 0.02 | 0.001 | Bal. |

TABLE 2

| | | | Concentration of Mg in solid-solution state (ingot) | | | Concentration of Mg in solid-solution state (unanodized sheet) | | |
|---|---|---|---|---|---|---|---|---|
| Sample | Alloy | Homogenization conditions (temp. (° C.)-time (h)) | Area having diameter of 5 μm and positioned in center area of crystal grain (A) | Area positioned away from grain boundary by 2.5 μm (B) | Difference in concentration of Mg (ingot) (\|A − B\|) | Concentration of Mg in one band (C) | Concentration of Mg in adjacent band (D) | Difference in concentration of Mg (unanodized sheet) (\|C − D\|) |
| 1 | A | 580-5 | 0.92 | 1.34 | 0.42 | 1.08 | 1.18 | 0.10 |
| 2 | B | 545-12 | 3.31 | 3.72 | 0.41 | 3.47 | 3.58 | 0.11 |
| 3 | C | 545-24 | 5.20 | 5.95 | 0.75 | 5.49 | 5.67 | 0.18 |
| 4 | D | 580-5 | 0.90 | 1.31 | 0.41 | 1.06 | 1.15 | 0.09 |
| 5 | A | 490-3 | 0.76 | 1.58 | 0.82 | 1.03 | 1.25 | 0.22 |
| 6 | B | 455-3 | 3.01 | 3.98 | 0.97 | 3.41 | 3.67 | 0.26 |
| 7 | C | 470-3 | 4.85 | 6.06 | 1.21 | 5.40 | 5.77 | 0.37 |
| 8 | D | 490-3 | 0.74 | 1.57 | 0.83 | 1.01 | 1.24 | 0.23 |

TABLE 3

| | | Concentration of Mg in solid-solution state (anodized sheet) | | | |
|---|---|---|---|---|---|
| Sample | Alloy | Concentration of Mg in one band (E) | Concentration of Mg in adjacent band (F) | Difference in concentration of Mg (anodized sheet) (\|E − F\|) | Streak pattern after anodizing |
| 1 | A | 0.21 | 0.25 | 0.04 | No |
| 2 | B | 0.56 | 0.60 | 0.04 | No |
| 3 | C | 0.88 | 0.93 | 0.05 | No |
| 4 | D | 0.20 | 0.24 | 0.04 | No |
| 5 | A | 0.19 | 0.28 | 0.09 | Yes |

TABLE 3-continued

| Sample | Alloy | Concentration of Mg in solid-solution state (anodized sheet): Concentration of Mg in one band (E) | Concentration of Mg in adjacent band (F) | Difference in concentration of Mg (anodized sheet) (\|E − F\|) | Streak pattern after anodizing |
|---|---|---|---|---|---|
| 6 | B | 0.53 | 0.64 | 0.11 | Yes |
| 7 | C | 0.83 | 0.97 | 0.14 | Yes |
| 8 | D | 0.18 | 0.28 | 0.10 | Yes |

Although only some exemplary embodiments and/or examples of the invention have been described in detail above, those skilled in the art will readily appreciate that many modifications are possible in the exemplary embodiments and/or examples without materially departing from the novel teachings and advantages of the invention. Accordingly, all such modifications are intended to be included within the scope of the invention.

The documents described in the specification are incorporated herein by reference in their entirety.

What is claimed is:

1. An aluminum alloy sheet comprising a 5000 series aluminum alloy sheet containing 1.0-6.0 mass % of Mg, the Mg concentration in a solid-solution state that is present in an outermost surface area of the aluminum alloy sheet varying in a widthwise direction of the aluminum alloy sheet in the form of a band having a width of a least 0.05 mm and a difference in the concentration of Mg between adjacent bands is no more than 0.20 mass %, and an oxide coating provided thereon.

2. The aluminum alloy sheet according to claim 1, comprising 1.0 to 6.0 mass % of Mg, and one or more elements selected from 0.001 to 0.1 mass % of Ti, 0.4 mass % or less of Cr, 0.5 mass % or less of Cu, 0.5 mass % or less of Mn, 0.4 mass % or less of Fe, and 0.3 mass % or less of Si, with the balance being Al and unavoidable impurities.

3. A method for producing the aluminum alloy sheet according to claim 1, the method comprising subjecting an ingot to hot rolling and cold rolling to produce an aluminum alloy sheet, a rolling target side of the ingot having a structure in which a difference in concentration of Mg between an area having a diameter of 5 μm and positioned in a center area of a crystal grain and an area having a diameter of 5 μm and positioned away from a grain boundary of the crystal grain by 2.5 μm is 0.80 mass % or less.

* * * * *